US012405022B2

(12) United States Patent
Hjortland

(10) Patent No.: US 12,405,022 B2
(45) Date of Patent: Sep. 2, 2025

(54) ENERGY EFFICIENT HEAT PUMP WITH COUNTERFLOW HEAT TRANSFER ARRANGEMENT

(71) Applicant: Johnson Controls Tyco IP Holdings LLP, Milwaukee, WI (US)

(72) Inventor: Andrew Leroy Hjortland, Stoughton, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/307,668

(22) Filed: Apr. 26, 2023

(65) Prior Publication Data

US 2023/0349581 A1 Nov. 2, 2023

Related U.S. Application Data

(60) Provisional application No. 63/336,173, filed on Apr. 28, 2022.

(51) Int. Cl.

| | |
|---|---|
| ***F24F 11/67*** | (2018.01) |
| ***F24F 1/10*** | (2011.01) |
| ***F25B 1/00*** | (2006.01) |

(52) U.S. Cl.

CPC ..... *F24F 11/67* (2018.01); *F24F 1/10* (2013.01); *F25B 1/00* (2013.01)

(58) Field of Classification Search

CPC .... F25B 1/10; F25B 1/00; F25B 41/48; F24F 11/67

See application file for complete search history.

(56) References Cited

U.S. PATENT DOCUMENTS

| | | | | |
|---|---|---|---|---|
| 2004/0168456 | A1* | 9/2004 | Chiang | F28F 1/32 165/182 |
| 2016/0061494 | A1* | 3/2016 | Vasvari | F25B 13/00 62/324.1 |
| 2021/0033315 | A1* | 2/2021 | Wallet-Laïly | F25B 13/00 |

FOREIGN PATENT DOCUMENTS

| | | | | |
|---|---|---|---|---|
| CN | 107270593 | A * | 10/2017 | F25B 13/00 |
| WO | WO-2018109894 | A1 * | 6/2018 | F25B 1/00 |
| WO | WO-2019138493 | A1 * | 7/2019 | F24F 1/30 |

OTHER PUBLICATIONS

WO-2019138493-A1 Translation (Year: 2019).*
WO-2018109894-A1 Translation (Year: 2018).*
CN 107270593 A Translation (Year: 2017).*

* cited by examiner

*Primary Examiner* — Schyler S Sanks
(74) *Attorney, Agent, or Firm* — Fletcher Yoder, P.C.

(57) ABSTRACT

An energy efficient heat pump for a heating, ventilation, and air conditioning (HVAC) system includes a compressor system configured to direct a working fluid along a working fluid circuit of the heat pump. The compressor system includes a first compressor configured to direct the working fluid along a first portion of the working fluid circuit having a first expansion device to operate the heat pump in a cooling mode and includes a second compressor configured to direct the working fluid along a second portion of the working fluid circuit having a second expansion device to operate the heat pump in a heating mode. The heat pump also includes a controller communicatively coupled to the first compressor and the second compressor, where the controller is configured to operate the first compressor and suspend operation of the second compressor in the cooling mode and to operate the second compressor and suspend operation of the first compressor in the heating mode.

20 Claims, 9 Drawing Sheets

ENERGY EFFICIENT HEAT PUMP WITH COUNTERFLOW HEAT TRANSFER ARRANGEMENT

CROSS REFERENCE TO RELATED APPLICATIONS

This application claims priority to and the benefit of U.S. Provisional Application No. 63/336,173, entitled "HEAT PUMP CONTROL SYSTEMS AND METHODS," filed Apr. 28, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems with improved heat exchange efficiency. More particularly, embodiments of the present disclosure are directed to reducing energy consumption by employing a counterflow heat transfer arrangement, which limits corresponding emissions.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, the HVAC system includes a reversing valve that enables reversal of refrigerant flow through the refrigerant circuit. As such, the reversing valve enables the condenser to operate as an evaporator (e.g., a heat absorber) and the evaporator to operate as a condenser (e.g., a heat rejector). Accordingly, the HVAC system may operate as a heat pump system in multiple operating modes (e.g., a cooling mode, a heating mode) to provide both heating and cooling to the building with one refrigeration circuit. Unfortunately, implementation of reversing valves in conventional heat pump systems may reduce an overall operational efficiency of the HVAC system. It is now recognized that such inefficiencies can result in unnecessary energy consumption and associated emissions.

SUMMARY

In one embodiment, an energy efficient heat pump for a heating, ventilation, and air conditioning (HVAC) system includes a compressor system configured to direct a working fluid along a working fluid circuit of the heat pump. The compressor system includes a first compressor configured to direct the working fluid along a first portion of the working fluid circuit having a first expansion device to operate the heat pump in a cooling mode and includes a second compressor configured to direct the working fluid along a second portion of the working fluid circuit having a second expansion device to operate the heat pump in a heating mode. The heat pump also includes a controller communicatively coupled to the first compressor and the second compressor, where the controller is configured to operate the first compressor and suspend operation of the second compressor in the cooling mode and to operate the second compressor and suspend operation of the first compressor in the heating mode.

In another embodiment, an energy efficient heat pump for a heating, ventilation, and air conditioning (HVAC) system includes a working fluid circuit having a first compressor, a first expansion device, a second compressor, a second expansion device, and a heat exchanger. The heat exchanger is configured to place a working fluid directed through the working fluid circuit in a counterflow arrangement with an air flow directed across the heat exchanger in a cooling mode of the heat pump and in a heating mode of the heat pump. The heat pump also includes a controller communicatively coupled to the first compressor and the second compressor, where the controller is configured to operate the first compressor and suspend operation of the second compressor in the cooling mode and to operate the second compressor and suspend operation of the first compressor in the heating mode.

In a further embodiment, an energy efficient heat pump for a heating, ventilation, and air conditioning (HVAC) system includes a working fluid circuit configured to circulate a working fluid therethrough, a first compressor disposed along the working fluid circuit and configured to direct the working fluid through the working fluid circuit in a designated flow direction, a second compressor disposed along the working fluid circuit and configured to direct the working fluid through the working fluid circuit in the designated flow direction, and a heat exchanger disposed along the working fluid circuit. The heat exchanger is configured to place the working fluid in a counterflow arrangement with an air flow directed across the heat exchanger in a cooling mode of the heat pump and in a heating mode of the heat pump. The heat pump also includes a controller communicatively coupled to the first compressor and the second compressor, where the controller is configured to operate the first compressor and suspend operation of the second compressor in the cooling mode and to operate the second compressor and suspend operation of the first compressor in the heating mode.

DETAILED DESCRIPTION

Figure 1:
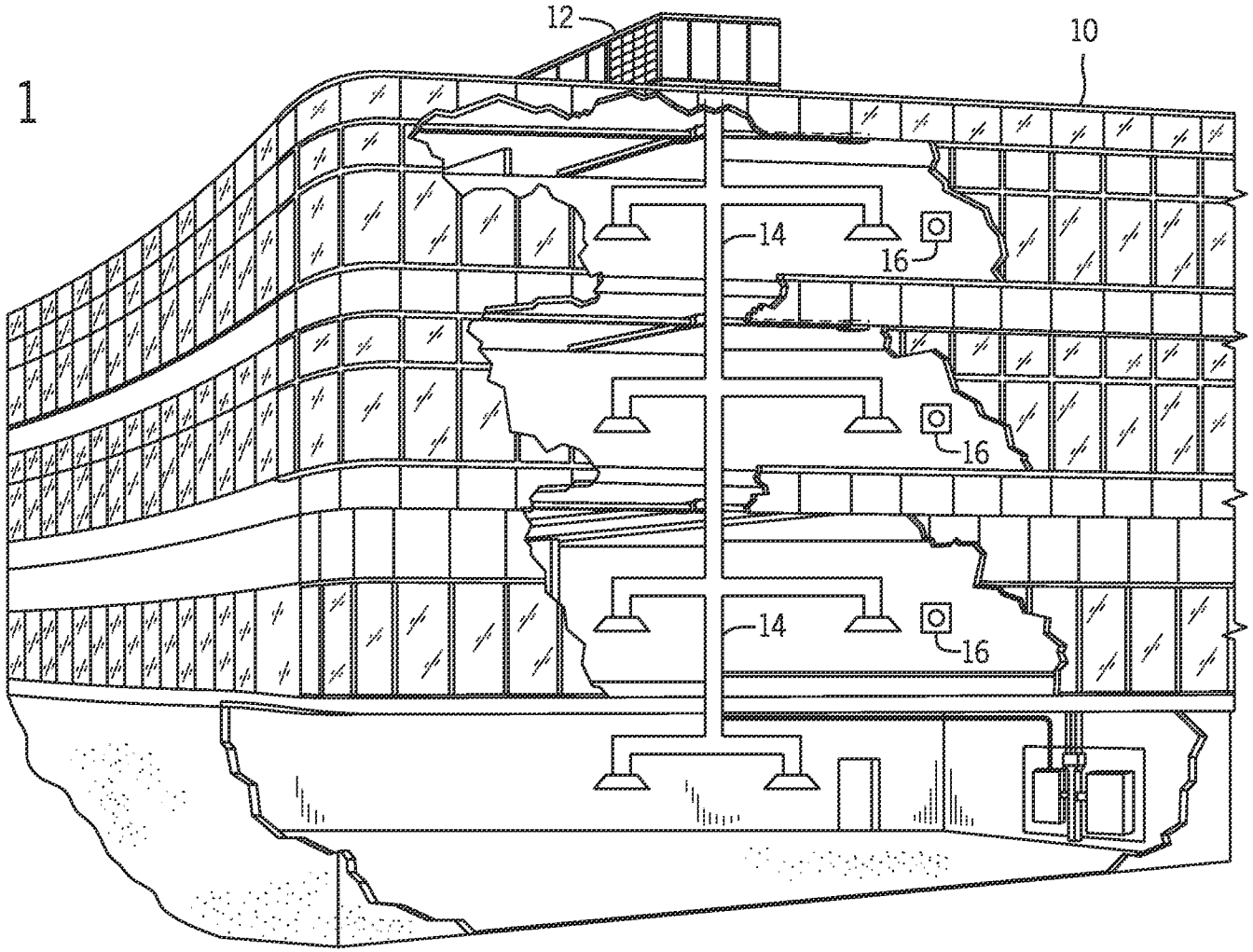
FIG. 1 is a perspective view of an embodiment of a building incorporating a heating, ventilation, and air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit (e.g., refrigerant circuit). A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within a building and/or the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load (e.g., an air flow to be conditioned) and the ambient environment, for example. The heat pump system is operable to provide both cooling and heating to the space to be conditioned (e.g., a room, zone, or other region within a building) by adjusting a flow of the working fluid through the working fluid circuit. Thus, the heat pump may not include a dedicated heating system, such as a furnace or burner configured to combust a fuel, to enable operation of the HVAC system in the heating mode. As a result, the heat pump operates with reduced greenhouse gas emissions.

For example, during operation of the heat pump system in a cooling mode, the compressor may direct working fluid through the working fluid circuit and the first and second heat exchangers in a first flow direction. While receiving working fluid in the first flow direction, the first heat exchanger (which may operate to condition an air flow supplied to a space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (i.e., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the current operational mode of the heat pump system (e.g., based on a flow direction of working fluid along the working fluid circuit).

Unfortunately, implementation of the reversing valve in the heat pump system may increase manufacturing complexity and/or overall manufacturing cost of the HVAC system. Moreover, in some cases, inclusion of the reversing valve in the heat pump system may cause a pressure drop along the working fluid circuit that may adversely affect an operational efficiency of the HVAC system. Inclusion of a reversing valve in the heat pump system may also cause heat transfer between the hot and cold working fluids that may adversely affect an operational efficiency of the HVAC system. Further, the reversing valve may incur wear or performance degradation over time, which may result in reduced operational reliability of the HVAC system. For example, upon occurrence of a fault condition in the reversing valve, operation of the HVAC system may be temporality suspended until an operator (e.g., a service technician) performs maintenance or repair on the reversing valve.

Moreover, reversing a working fluid flow direction through the heat exchangers of the heat pump system (e.g., via operation of the reversing valve, during switching between heating and cooling modes) may result in one or more of the heat exchangers operating in a parallel flow configuration, with respect to air flow directed across the heat exchanger(s), which may reduce an overall operational efficiency of the heat pump system. For example, a fan or blower may be configured to direct air across a heat exchanger of the heat pump system in a designated air flow direction that extends across one or more tubes or pipes (e.g., one or more coils) of the heat exchanger. The heat exchanger may include, for example, a first row of tubes, a second row of tubes, and a third row of tubes that may be spaced along a depth of the heat exchanger. The fan may be configured to direct air sequentially across the first row of tubes, the second row of tubes, and the third row of tubes. In a counterflow configuration of the heat exchanger, working fluid may flow across or through the heat exchanger (e.g., in a first direction) serially through the third row of tubes, through the second row of tubes, and through the first row of tubes, such that a flow direction of working fluid along the depth of the heat exchanger (e.g., through the rows of tubes) is opposite to the air flow direction across the depth of the heat exchanger (e.g., across the rows of tubes). In the parallel flow configuration of the heat exchanger, working fluid may flow across or through the heat exchanger (e.g., in a second direction, opposite the first direction) serially through the first row of tubes, through the second row of tubes, and through the third row of tubes, such that the flow direction of working fluid along the depth of the heat exchanger (e.g., through the rows of tubes) is the same as the air flow direction across the depth of the heat exchanger (e.g., across the rows of tubes). Unfortunately, operating the heat exchanger in the parallel flow configuration may reduce an overall heat transfer efficiency (e.g., a heat transfer rate and/or a heat transfer effectiveness) between the working fluid flowing through the heat exchanger and the air directed across the heat exchanger, with respect to operating the heat exchanger in the counterflow configuration.

Further, utilization of a compressor for operating the heat pump in both the cooling mode and the heating mode (e.g., via cooperation with the reversing valve) may result in a reduction in an overall operational efficiency of the HVAC system. For example, in many cases, pressure differentials or pressure ratios across various components (e.g., the compressor) or sections of the working fluid circuit may vary based on the mode (e.g., cooling, heating) in which the heat pump system operates. As an example, pressure ratios across the compressor of the working fluid circuit may be relatively small while the heat pump system operates in the cooling mode and may be relatively large while the heat pump system operates in the heating mode. In particular, such pressure ratios may be indicative of a differential between an entering working fluid pressure at an inlet of the compressor and a exiting working fluid pressure at an outlet of the compressor. Typically, a volume index (e.g., a volume ratio) of the compressor coupled to the working fluid circuit may be fixed (e.g., invariable), which may cause the compressor to be ill-suited or incapable of adjusting working fluid compression and working fluid circulation along the working fluid circuit in response to the varying pressure differentials that may be encountered between operation in the cooling and heating modes of the heat pump system. In some cases, certain compressors may be ill-suited and/or inefficient in certain HVAC system applications (e.g., based on amounts of heating and cooling typically desired in a particular HVAC system application). For example, a heating load of a heat pump may be greater in a cold climate than in a warm climate, but a cooling load of the heat pump in the same cold climate may be lower. In such applications, the heat pump may include a compressor that operates adequately in a heating mode to satisfy a greater heating demand in the cold climate, but the compressor may operate inefficiently in a cooling mode (e.g., the compressor cycle on and off more frequently in the cooling mode, which may reduce a useful life of the compressor).

For at least the foregoing reasons, conventional compressor and reversing valve systems of traditional heat pumps may limit an overall operational efficiency of the HVAC system throughout a duration in which the heat pump operates in the cooling mode, the heating mode, or both (e.g., based on an instant position of the reversing valve). As such, it is presently recognized that removal of a reversing valve from the working fluid circuit of the heat pump system, avoidance of parallel flow operation of one or more heat exchangers of the heat pump system, and enabling improved compressor selection for heating and cooling modes of the heat pump system may mitigate or substantially reduce the aforementioned shortcomings of conventional HVAC systems.

Accordingly, embodiments of the present disclosure relate to a heat pump system that is configured to selectively operate in both a cooling mode or a heating mode without implementation of a reversing valve and without operating heat exchangers of the heat pump system in a parallel flow configuration. That is, the heat pump system of the present disclosure excludes a reversing valve disposed along the working fluid circuit (e.g., between heat exchangers and a compressor or compressor system of the HVAC system). Moreover, the disclosed heat pump system may enable selective operation of one or more heating mode compressors and one or more cooling mode compressors to enable heat exchangers of the heat pump system to operate in the counterflow configuration during both the heating mode of the heat pump system and the cooling mode of the heat pump system. As such, implementation of the disclosed heat pump system may improve the overall operational efficiency (e.g., with improved heat transfer, with reduced energy consumption) of the HVAC system during cooling and heating operations, as well as reduce costs and complexity associated with operation and/or maintenance of the HVAC system.

For example, the heat pump system disclosed herein may include a first compressor (or a first group of compressors) and a second compressor (or a second group of compressors) that are fluidly coupled to the working fluid circuit. The first compressor may be associated with a first expansion valve (e.g., an electronic expansion valve [EEV]) of the vapor compressor system, and the second compressor may be associated with a second expansion valve (e.g., an electronic expansion valve [EEV]) of the vapor compression system. The first compressor may be coupled to and oriented along the working fluid circuit, and the first compressor may operate to direct working fluid through heat exchangers (e.g., a condenser, an evaporator) and the first expansion valve of the heat pump system in a designated flow direction to enable operation of the heat pump system in the cooling mode and to enable operation of one or more of, or all of, the heat exchangers in the counterflow configuration. The second compressor may be coupled to and oriented along the working fluid circuit, and the second compressor may operate to direct working fluid through heat exchangers and the second expansion valve of the heat pump system in a designated flow direction to enable operation of the heat pump system in the heating mode and to enable operation of one or more of, or all of, the heat exchangers in the counterflow configuration. As such, the heat pump system may operate, for example, an indoor heat exchanger (e.g., an indoor coil configured to condition a space) of the heat pump system in the counterflow configuration irrespectively of whether the heat pump system is operating in the cooling mode or the heating mode. In this way, the heat pump system may operate more efficiently (e.g., with improved heat transfer efficiency, with reduced energy consumption) in the cooling mode and in the heating mode.

In some embodiments, the first compressor (e.g., one or more compressors) may include operational characteristics (e.g., a volume index or compression ratio, a capacity, a power output) that facilitate enhanced operation of the heat pump system in the cooling mode, while the second compressor (e.g., one or more compressors) may include operational characteristics that facilitate enhanced operation of the heat pump system in the heating mode. A controller of the heat pump system may be configured to selectively operate the first compressor or the second compressor based on a desired operational mode of the heat pump system (e.g., cooling mode, heating mode). In this way, the controller is configured to enable switchable operation of the heat pump system in the cooling mode or the heating mode without involving operation (e.g., activation, adjustment, control) of a reversing valve and without involving operation of heat exchangers in the parallel flow configuration.

As an example, upon receiving a call (e.g., a control instruction) to operate the heat pump system in the cooling mode, the controller may activate the first compressor and retain the second compressor in an idle (e.g., inactive) state. In this way, the controller may operate the first compressor to direct working fluid through the first expansion valve and the heat exchangers (e.g., an indoor heat exchanger, an outdoor heat exchanger) of the heat pump system in a designated flow direction, thereby enabling operation of the heat pump system in the cooling mode and operation of, for example, the indoor heat exchanger, in the counterflow configuration. Conversely, upon receiving a call to operate the heat pump system in the heating mode, the controller may activate the second compressor and retain the first compressor in the idle state. As such, the controller may operate the second compressor to direct working fluid through the second expansion valve and the heat exchangers of the heat pump system in a designated flow direction to enable operation of the heat pump system in the heating mode and operation of, for example, the indoor heat exchanger, in the counterflow configuration. Indeed, heat pump systems incorporating the present techniques are configured to heat an air flow in an energy efficient manner and without operation of a furnace or other heating system configured to combust or consume a fuel and thereby provide a reduction of greenhouse gas emissions. Moreover, by enabling operation of heat exchangers of the heat pump system in the counterflow arrangement in both the heating mode and the cooling mode, present embodiments enable operation of the heat pump system (e.g., the first and second compressors) with improved efficiency and with reduced energy consumption.

As discussed in detail below, the controller may selectively operate individual compressors, combinations of compressors, and/or additional components (e.g., valves, fans, blowers, etc.) included in the heat pump system in accordance with the presently disclosed techniques. Moreover, it should be understood that one or more of the compressors included in the heat pump system may be fixed speed (e.g., fixed capacity) compressors, multi-stage (e.g., two stage) compressors, and/or variable speed compressors. Further, as discussed herein, the disclosed techniques may be implemented in heat pump systems that include a liquid-to-suction heat exchanger, a subcooler heat exchanger, a combination thereof, and/or other suitable heat pump systems. Moreover, it should be appreciated that the heat pump system disclosed herein may be implemented in air-to-air heat pump applications, air-to-water heat pump applications, and/or water-to-water heat pump applications. These and other features will be described below with reference to the drawings.

Turning now to the drawings, FIG. 1 illustrates an embodiment of a heating, ventilation, and air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled system that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one working fluid circuit configured to operate in different modes. In other embodiments, the HVAC unit 12 may include one or more working fluid circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
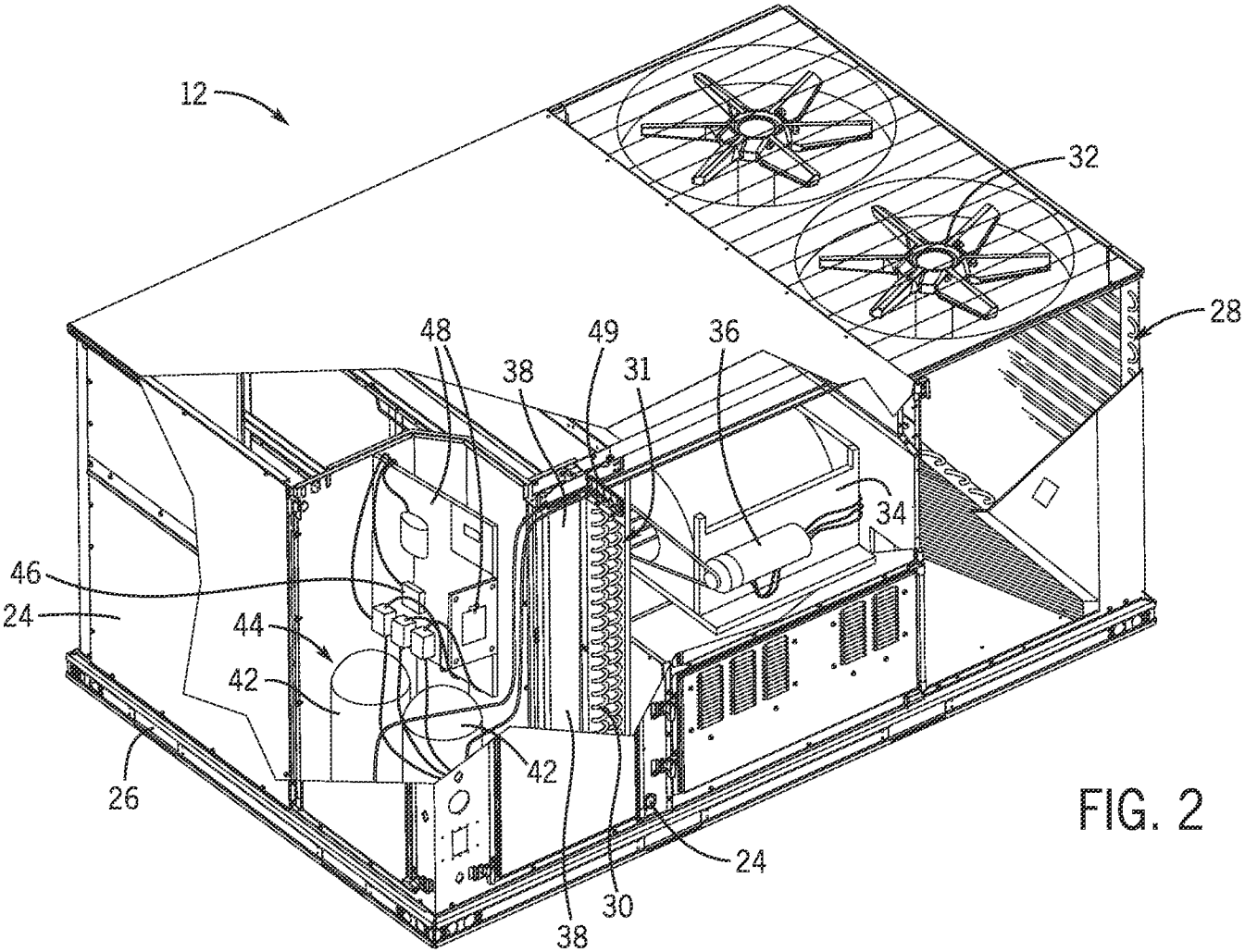
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent working fluid circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate working fluid, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
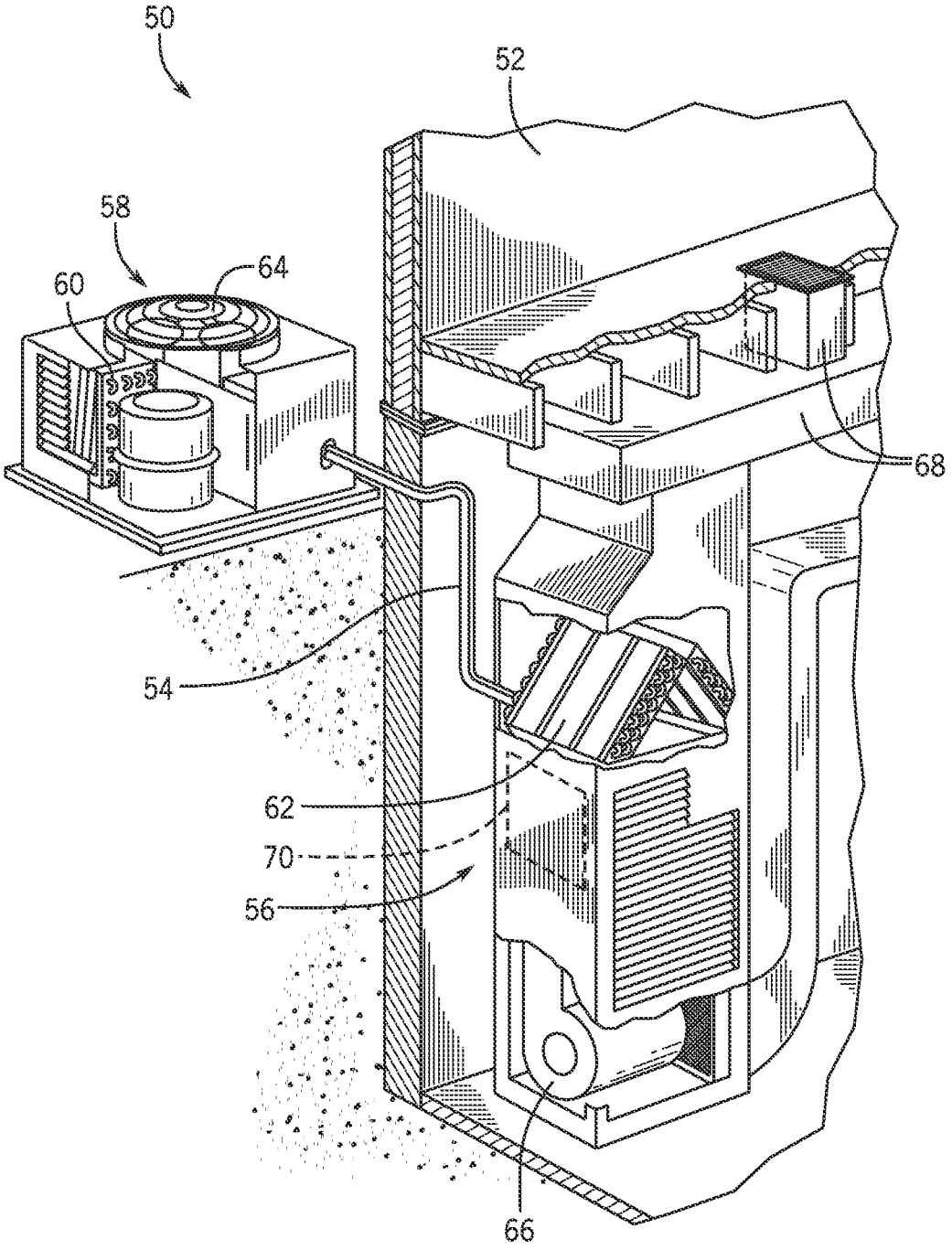
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 (e.g., refrigerant conduits) that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
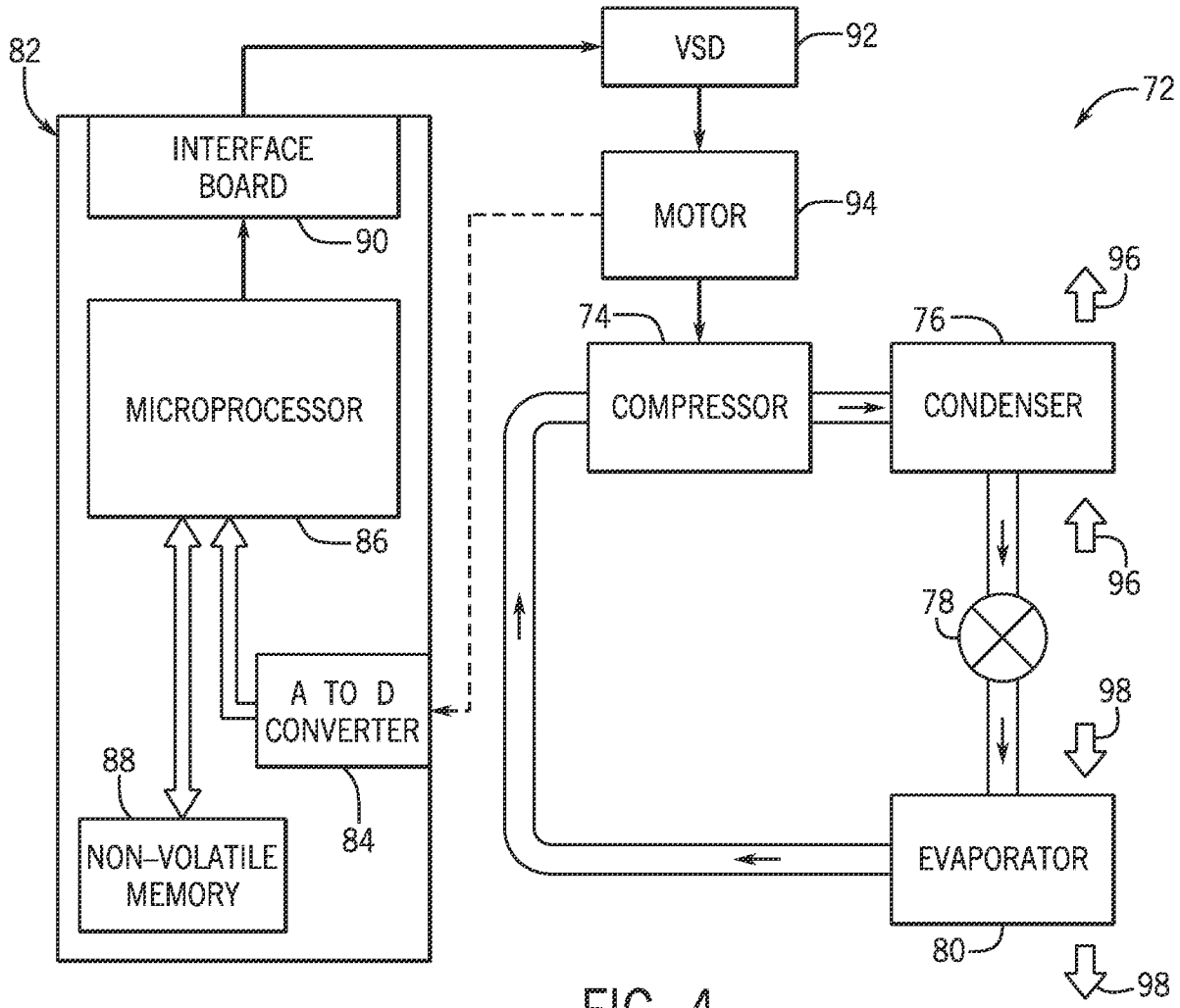
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid (e.g., refrigerant) through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96.

The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system having an improved heat pump system. Specifically, embodiments of the present disclosure are directed to an HVAC system configured to place a working fluid and an air flow in a counterflow arrangement in both a heating mode and a cooling mode of the HVAC system. For example, the HVAC system may be a heat pump (e.g., a central HVAC system) configured to operating in the heating mode and the cooling mode. The heat pump may include a vapor compression circuit configured to circulate working fluid therethrough in a first direction in the heating mode and in a second direction, opposite the first direction, in the cooling mode. The vapor compression circuit may further include a conduit system configured to place the working fluid in a counterflow arrangement with the air flow (e.g., via a heat exchanger of the vapor compression circuit) in both the heating mode and the cooling mode. By enabling and providing a counterflow heat transfer arrangement between the working fluid and the air flow in both the heating mode and the cooling mode, the vapor compression circuit (e.g., heat pump) may operate with improved heat transfer efficiency, reduced energy consumption, and greater overall HVAC system efficiency.

Figure 5:
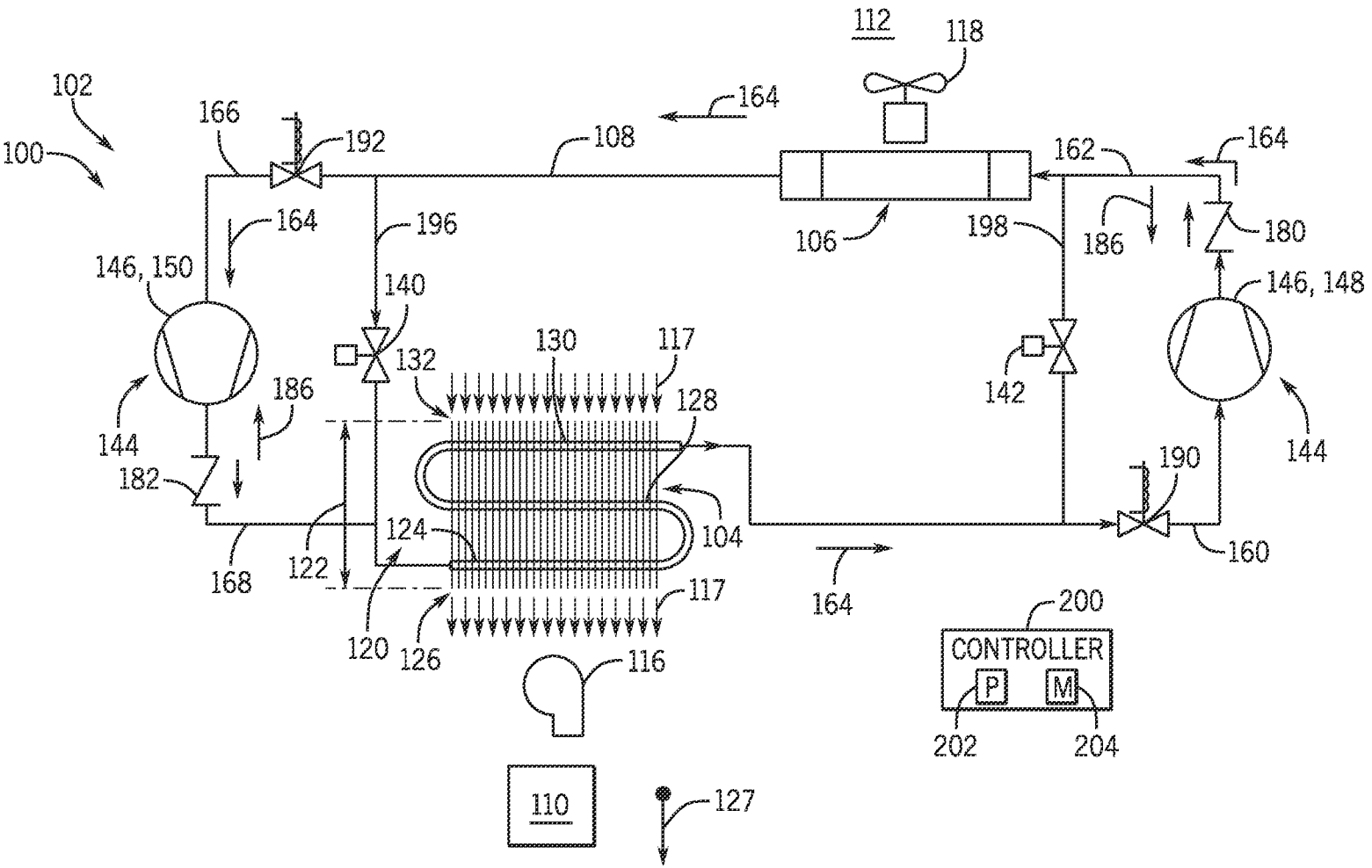
FIG. 5 is a schematic diagram of an embodiment of a portion of an HVAC system that includes a heat pump system, in accordance with an aspect of the present disclosure.

To provide context for the following discussion, FIG. 5 is a schematic of an embodiment of a portion of an HVAC system 100 that includes a heat pump 102 (e.g., a heat pump system, a reversible heat pump, an energy efficient heat pump) in accordance with present embodiments. The heat pump 102 may include one or more components of the vapor compression system 72 discussed above and/or may be included in any of the systems described above (e.g., the HVAC unit 12, the heating and cooling system 50). The heat pump 102 includes a first heat exchanger 104 and a second heat exchanger 106 that are fluidly coupled to one another via a working fluid circuit 108 or working fluid loop (e.g., one or more conduits, refrigerant circuit). The first heat exchanger 104 may be in thermal communication with (e.g., fluidly coupled to) a thermal load 110 (e.g., a room, space, and/or device) serviced by the heat pump 102, and the second heat exchanger 106 may be in thermal communication with an ambient environment 112 (e.g., the atmosphere) surrounding the HVAC system 100.

In some embodiments, a first fan 116 (e.g., blower) may direct a first air flow 117 across the first heat exchanger 104 to facilitate heat exchange between working fluid within the first heat exchanger 104 and the thermal load 110, while a second fan 118 may direct a second air flow across the second heat exchanger 106 to facilitate heat exchange between working fluid within the second heat exchanger 106 and the ambient environment 112. In the illustrated embodiment, the first heat exchanger 104 includes a plurality of passes 120 (e.g., slabs, circuits, rows, tubes) configured to direct working fluid through the first heat exchanger 104. As such, the first heat exchanger 104 may be a multi-slab heat exchanger or a multi-pass heat exchanger. In some embodiments, the passes 120 may be stacked, arranged, or otherwise spaced along a depth 122 of the first heat exchanger 104. As an example, the passes 120 may include a first pass 124 positioned at or near a downstream side 126 of the first heat exchanger 104 (e.g., with respect to a direction 127 of the first air flow 117 across the first heat exchanger 104), a second pass 128 positioned upstream of the first pass 124 (e.g., with respect to the direction 127 of the first air flow 117 across the first heat exchanger 104), and a third pass 130 positioned upstream of the first pass 124 and the second pass 128 and at or near an upstream side 132 of the first heat exchanger 104 (e.g., with respect to the direction 127 of the first air flow 117 across the first heat exchanger 104). As such, operation of the first fan 116 may sequentially direct the first air flow 117 across the third pass 130, the second pass 128, and the first pass 124 of the first heat exchanger 104. In other embodiments, the first heat exchanger 104 may include additional or fewer passes 120 than those shown in the illustrated embodiment of FIG. 5.

Moreover, in certain embodiments, the second heat exchanger 106 may be a multi-pass or multi-slab heat exchanger having a plurality of passes similar to the plurality of passes 120 of the first heat exchanger 104. That is, the second heat exchanger 106 may include tubes arranged in a plurality of passes configured to direct working fluid through the plurality of passes in a first sequential order, and the second fan 118 may direct a second air flow across the plurality of passes of the second heat exchanger 106 in a second (e.g., reverse) sequential order. In other embodiments, the second heat exchanger 106 may be a single slab heat exchanger having a single row of tubes extending along a length or width of the second heat exchanger 106.

In the illustrated embodiment, the heat pump 102 includes a first expansion device 140 (e.g., an electronic expansion valve [EEV]) and a second expansion device 142 (e.g., an EEV) disposed along the working fluid circuit 108. The first and second expansion devices 140, 142 are each positioned between the first heat exchanger 104 and the second heat exchanger 106 and may be configured to regulate (e.g., throttle) a flow of working fluid and/or a working fluid pressure differential between the first and second heat exchangers 104, 106.

The heat pump 102 also includes a compressor system 144 disposed along the working fluid circuit 108. The compressor system 144 includes a plurality of compressors 146, such as a first compressor 148 and a second compressor 150, which, as discussed below, are each configured to direct working fluid flow through the first heat exchanger 104, the second heat exchanger 106, and remaining components that may be fluidly coupled to the working fluid circuit 108. Although the compressor system 144 is shown as having two compressors 146 in the illustrated embodiment, the compressor system 144 may include any suitable quantity of compressors 146, such as three, four, five, six, or more than six compressors 146. For example, the first compressor 148 may be representative of a compressor sub-system having two, three, four, five, six, or more than six compressors 146, and the second compressor 150 may be representative of a compressor sub-system having two, three, four, five, six, or more than six compressors 146. In some embodiments, the compressor system 144 may include multiple first compressors 148 and/or multiple second compressors 150, and the multiple first compressors 148 and/or multiple second compressors 150 may be operated (e.g., sequenced, staged, etc.) in response to varying loads on the heat pump 102. One or more of the compressors 146 included in the compressor sub-systems may be fixed speed compressors, multi-stage (e.g., two stage) compressors, and/or variable speed compressors. As discussed below, any one or combination of the compressors 146 included in the compressor sub-systems may be activated and controlled in accordance with the presently disclosed techniques.

In the illustrated embodiment, the working fluid circuit 108 includes a first suction conduit 160 (e.g., one or more conduits) that extends between the first compressor 148 (e.g., a suction side of the first compressor 148) and the first heat exchanger 104. A first discharge conduit 162 extends between the first compressor 148 (e.g., a discharge side of the first compressor 148) and the second heat exchanger 106. Therefore, the first compressor 148 may be operable to draw (e.g., intake) a working fluid flow from the first heat exchanger 104 (e.g., via the first suction conduit 160) and discharge (e.g., output) the working fluid flow to the second heat exchanger 106 (e.g., via the first discharge conduit 162). As such, during certain operating modes of the heat pump 102, the first compressor 148 may receive a flow of working fluid from the first heat exchanger 104 and discharge a flow of the working fluid to the second heat exchanger 106. That is, the first compressor 148 may direct a working fluid flow through at least a portion of the working fluid circuit 108 in a designated flow direction 164.

In some embodiments, a second suction conduit 166 extends between the second compressor 150 (e.g., a suction side of the second compressor 150) and the second heat exchanger 106. A second discharge conduit 168 extends between the second compressor 150 (e.g., a discharge side of the second compressor 150) and the first heat exchanger 104. Therefore, the second compressor 150 may be operable to draw (e.g., intake) a working fluid flow from the second heat exchanger 106 (e.g., via the second suction conduit 166) and discharge (e.g., output) the working fluid flow to the first heat exchanger 104 (e.g., via the second discharge conduit 168). As such, during certain operating modes of the heat pump 102, the second compressor 150 may receive a flow of working fluid from the second heat exchanger 106 and discharge a flow of working fluid to the first heat exchanger 104. That is, the second compressor 150 may direct a working fluid flow through at least a portion of the working fluid circuit 108 in the designated flow direction 164.

In some embodiments, the heat pump 102 may include a first check valve 180 disposed along (e.g., coupled to) the first discharge conduit 162 and a second check valve 182 disposed along the second discharge conduit 168. The first check valve 180 may be configured to block flow of working fluid into and/or through the first compressor 148 in a reverse flow direction 186, and the second check valve 182 may be configured to block flow of working fluid into and/or through the second compressor 150 in the reverse flow direction 186.

The heat pump 102 may include a first control valve 190 (e.g., a solenoid valve) disposed along (e.g., coupled to) the first suction conduit 160 and a second control valve 192 (e.g., a solenoid valve) disposed along the second suction conduit 166. The first control valve 190 and the second control valve 192 may be selectively actuatable (e.g., based on control instructions) to enable or block flow of working fluid to the first compressor 148 and the second compressor 150, respectively. In some embodiments, the first control valve 190, the second control valve 192, or both, may be replaced with check valves (e.g., similar to the check valves 180 and 182). Additionally or alternatively, the first check valve 180, the second check valve 182, or both, may be replaced with control valves (e.g., similar to the control valves 190 and 192). Further, in certain embodiments, any or all of the first and second check valves 180, 182 and the first and second control valves 190, 192 may be omitted from the working fluid circuit 108. For example, in such embodiments, the first compressor 148 may include internal features (e.g., one or more valves or flow control devices) configured to block flow of working fluid in the reverse flow direction 186 through the first compressor 148, and the second compressor 150 may include internal features (e.g., one or more valves or flow control devices) configured to block flow of working fluid in the reverse flow direction 186 through the second compressor 150. In some embodiments, the first compressor 148, the second compressor 150, or both, may include high side shell (HSS) compressors. In other embodiments, the first compressor 148, the second compressor 150, or both, may include low side shell (LSS) compressors.

As discussed below, the first compressor 148 enables the heat pump 102 to operate in a cooling mode, in which the first heat exchanger 104 absorbs thermal energy from the thermal load 110 to cool the thermal load 110, and the second heat exchanger 106 rejects the absorbed thermal energy (e.g., absorbed from the thermal load 110) to the ambient environment 112. Further, the second compressor 150 enables the heat pump 102 to operate in a heating mode, in which the second heat exchanger 106 absorbs thermal energy from the ambient environment 112, and the first heat exchanger 104 rejects the absorbed thermal energy (e.g., absorbed from the ambient environment 112) to the thermal load 110 to heat the thermal load 110. Notably, switching between operation of the first compressor 148 and operation of the second compressor 150 enables switching of an operational mode of the heat pump 102 between the cooling mode and the heating mode, respectively, without utilization of a reversing valve. As such, the heat pump 102 may exclude a reversing valve disposed along the working fluid circuit 108. That is, the heat pump 102 may not include a reversing valve disposed along or coupled to the first suction conduit 160, the first discharge conduit 162, the second suction conduit 166, and the second discharge conduit 168, for example. Moreover, the check valves 180, 182 and/or the control valves 190, 192 may cooperate to enable operation of the first heat exchanger 104, the second heat exchanger 106, or both, in a counterflow configuration, irrespectively of whether the heat pump 102 is operating in the cooling mode or the heating mode. Thus, the heat pump 102 is configured to operate with improved heat transfer efficiency, reduced energy consumption, and greater overall HVAC system efficiency. Indeed, the heat pump 102 may operate with reduced greenhouse gas emissions by operating to heat and cool an air flow in a more energy efficient manner and without operation of a furnace or other system that consumes a fuel.

For clarity, as used herein, a counterflow configuration of a heat exchanger, such as the first heat exchanger 104, may refer to a configuration of the heat exchanger in which air is directed (e.g., sequentially) across passes 120 of the heat exchanger in an order or sequence that is opposite to an order or sequence in which working fluid flows (e.g., sequentially) through the passes 120 of the heat exchanger. For example, the counterflow configuration of the first heat exchanger 104 may be indicative of an operational configuration of the first heat exchanger 104 in which the first air flow 117 is sequentially directed across the tubes corresponding to the third pass 130, the second pass 128, and the first pass 124 of the first heat exchanger 104, while working fluid flow is sequentially directed through respective tubes of the first pass 124, the second pass 128, and the third pass 130. In other words, in the counterflow configuration, the first air flow 117 may flow across the passes 120 in a first sequential order (e.g., from the third pass 130 to the first pass 124), while working fluid flows through the passes in a second (e.g., reverse) sequential order (e.g., from the first pass 124 to the third pass 130). Enabling operation of the first heat exchanger 104 and/or second heat exchanger 106 in the counterflow configuration for both heating operations and cooling operations of the heat pump 102 may enhance an overall operational efficiency of the heat pump 102 (e.g., with reduced power consumption, with improved heat transfer efficiency).

For example, in the cooling mode of the heat pump 102, the first control valve 190 may be in an open configuration to enable working fluid flow therethrough, the first expansion device 140 may be in an open or a partially open position to enable working fluid flow therethrough, and the second control valve 192 and the second expansion device 142 may be in closed positions to block working fluid flow therethrough. Moreover, in the cooling mode of the heat pump 102, the first compressor 148 may be active (e.g., operational) to direct working fluid along the working fluid circuit 108 in the designated flow direction 164 while the second compressor 150 may be idle (e.g., inactive). As shown, the first expansion device 140 may be disposed along a conduit 196 (e.g., a first conduit) of the working fluid circuit 108 extending between (e.g., extending from and to) the second suction conduit 166 and the second discharge conduit 168. In other words, the first expansion device 140 may be disposed along the working fluid circuit 108 in a parallel arrangement with the second compressor 150. In the cooling mode of the heat pump 102, the first compressor 148 may direct working fluid through the second heat exchanger 106, the first expansion device 140, and the first heat exchanger 104 to enable the first heat exchanger 104 to condition (e.g., cool) the thermal load 110 while operating in the counterflow configuration.

In the heating mode, the second control valve 192 may be in an open configuration to enable working fluid flow therethrough, the second expansion device 142 may be in an open or a partially open position to enable working fluid flow therethrough, and the first control valve 190 and the first expansion device 140 may be in closed positions to block working fluid flow therethrough. Moreover, in the heating mode of the heat pump 102, the second compressor 150 may be active (e.g., operational) to direct working fluid along the working fluid circuit 108 in the designated flow direction 164 while the first compressor 148 may be idle (e.g., inactive). As shown, the second expansion device 142 may be disposed along a conduit 198 (e.g., a second conduit) of the working fluid circuit 108 extending between (e.g., extending from and to) the first suction conduit 160 and the first discharge conduit 162. In other words, the second expansion device 142 may be disposed along the working fluid circuit 108 in a parallel arrangement with the first compressor 148. In the heating mode of the heat pump 102, the second compressor 150 may direct working fluid through the first heat exchanger 104, the second expansion device 142, and the second heat exchanger 106 to enable the first heat exchanger 104 to condition (e.g., heat) the thermal load 110 while operating in the counterflow configuration.

Throughout the following discussion, the first compressor 148 may also be referred to herein as a cooling compressor 148 (e.g., cooling mode compressor), and the second compressor 150 may also be referred to as a heating compressor 150 (e.g., heating mode compressor). In some embodiments, the cooling compressor 148 may include operational characteristics (e.g., volume ratio, volume index, volume geometry, etc.) that are tailored (e.g., selected) to enhance operation of the heat pump 102 in the cooling mode. The heating compressor 150 may include operational characteristics (e.g., volume ratio, volume index, volume geometry, etc.) that are tailored (e.g., selected) to enhance operation of the heat pump 102 in the heating mode. In other words, the cooling compressor 148 may include operational characteristics that enable the cooling compressor 148 to more efficiently direct working fluid through the working fluid circuit 108 during operation of the heat pump 102 in the cooling mode (e.g., as compared to implementing the heating compressor 150 to direct working fluid through the working fluid circuit 108 in the cooling mode). The heating compressor 150 may include operational characteristics that enable the heating compressor 150 to more efficiently direct working fluid through the working fluid circuit 108 while the heat pump 102 operates in the heating mode (e.g., as compared to implementing the cooling compressor 148 to direct working fluid through the working fluid circuit 108 in the heating mode). The operational characteristics of the compressors 146 may include respective volume indices or compression ratios of the compressors 146, respective capacities or displacements (e.g., swept volumes) of the compressors 146 (e.g., a volume of fluid ingested by the compressor 146 per revolution of the compressor 146), respective motor sizes (e.g., torque or power ranges) of motors of the compressors 146, and/or other suitable parameters of the compressors 146. In certain embodiments, the operational characteristics of the cooling compressor 148 and/or the heating compressor 150 may be selected based on a climatic region (e.g., a geographical location) in which the heat pump 102 is implemented.

Moreover, in embodiments where the cooling compressor 148 includes a compressor sub-system having one or more compressors 146, the heating compressor 150 includes a compressor sub-system having one or more compressors 146, or both, it should be understood that each of the compressors 146 in the respective compressor sub-systems may be selected to enhance operation of the heat pump 102 in a particular mode (e.g., cooling, heating, defrost). For example, the operational characteristics of the cooling compressor 148 and/or the heating compressor 150 may be selected to enable more efficient operation (e.g., with reduced power consumption) during the corresponding operating mode of the heat pump 102 in which the compressor 148 and/or 150 operates. In embodiments of the cooling compressor 148 having a compressor sub-system with multiple compressors 146, the multiple cooling compressors 146 may be sequenced or staged in response to varying cooling loads on the heat pump 102. Similarly, in embodiments of the heating compressor 150 having a compressor sub-system with multiple compressors 146, the multiple heating compressors 146 may be sequenced or staged in response to varying heating loads on the heat pump 102.

The HVAC system 100 may include a controller 200 (e.g., a control system, a thermostat, a control panel, control circuitry) that is communicatively coupled to one or more components of the heat pump 102 and is configured to monitor, adjust, and/or otherwise control operation of the components of the heat pump 102. For example, one or more control transfer devices, such as wires, cables, wireless communication devices, and the like, may communicatively couple the compressors 146, the first and/or second expansion devices 140, 142, the first and/or second control valves 190, 192, the first and/or second fans 116, 118, the control device 16 (e.g., a thermostat), and/or any other suitable components of the HVAC system 100 to the controller 200. That is, the compressors 146, the first and second expansion devices 140, 142, the first and second control valves 190, 192, the first and second fans 116, 118, and/or the control device 16 may each have one or more communication components that facilitate wired or wireless (e.g., via a network) communication with the controller 200. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressors 146, the first and/or second expansion devices 140, 142, the first and/or second fans 116, 118, the first and/or second control valves 190, 192, and/or the control device 16 may wirelessly communicate data between each other. In other embodiments, operational control of certain components of the heat pump 102 may be regulated by one or more relays or switches (e.g., a 24 volt alternating current [VAC] relay).

In some embodiments, the controller 200 may be a component of or may include the control panel 82. In other embodiments, the controller 200 may be a standalone controller, a dedicated controller, or another suitable controller included in the HVAC system 100. In any case, the controller 200 is configured to control components of the HVAC system 100 in accordance with the techniques discussed herein. The controller 200 includes processing circuitry 202, such as a microprocessor, which may execute software for controlling the components of the HVAC system 100. The processing circuitry 202 may include multiple microprocessors, one or more "general-purpose" microprocessors, one or more special-purpose microprocessors, and/or one or more application specific integrated circuits (ASICS), or some combination thereof. For example, the processing circuitry 202 may include one or more reduced instruction set (RISC) processors.

The controller 200 may also include a memory device 204 (e.g., a memory) that may store information, such as instructions, control software, look up tables, configuration data, etc. The memory device 204 may include a volatile memory, such as random access memory (RAM), and/or a nonvolatile memory, such as read-only memory (ROM). The memory device 204 may store a variety of information and may be used for various purposes. For example, the memory device 204 may store processor-executable instructions including firmware or software for the processing circuitry 202 execute, such as instructions for controlling components of the HVAC system 100. In some embodiments, the memory device 204 is a tangible, non-transitory, machine-readable-medium that may store machine-readable instructions for the processing circuitry 202 to execute. The memory device 204 may include ROM, flash memory, a hard drive, or any other suitable optical, magnetic, or solid-state storage medium, or a combination thereof. The memory device 204 may store data, instructions, and any other suitable data.

Figure 6:
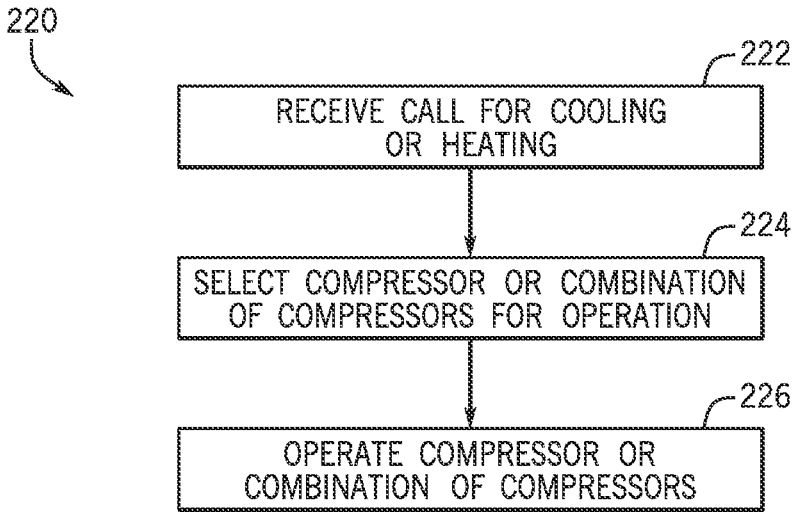
FIG. 6 is a flow diagram of an embodiment of a process for operating a heat pump system, in accordance with an aspect of the present disclosure.

To facilitate the following discussion, FIG. 6 is flow diagram of an embodiment of a process 220 for controlling the heat pump 102 in accordance with the presently disclosed techniques. FIG. 6 will be referenced concurrently with FIG. 5 throughout the following discussion. It should be noted that the steps of the process 220 discussed below may be performed in any suitable order and are not limited to the order shown in the illustrated embodiment of FIG. 6. Moreover, it should be noted that additional steps of the process 220 may be performed, and certain steps of the process 220 may be omitted. In some embodiments, the process 220 may be executed by the processing circuitry 202 of the controller 200 and/or any other suitable processing circuitry of the HVAC system 100. The process 220 may be stored (e.g., as executable instructions) on, for example, the memory 88 or the memory device 204.

The process 220 may begin with receiving a call for cooling or heating, as indicated by block 222. For example, the controller 200 may receive a call (e.g., a control instruction) from the control device 16 or another suitable controller instructing the controller 200 to operate the heat pump 102 in the cooling mode to cool the thermal load 110 or in the heating mode to heat the thermal load 110. In response to receiving the call for cooling or heating, the controller 200 may select a corresponding compressor 146 or combination of compressors 146 to operate to satisfy a demand of the thermal load 110, as indicated by block 224, and may subsequently operate the compressor 146 or combination of compressors 146, as indicated by block 226.

For example, in response to receiving a call to operate the heat pump 102 in the cooling mode, the controller 200 may send control instructions to operate the cooling compressor 148, to suspend or stay (e.g., block) operation of the heating compressor 150, to transition the first control valve 190 to an open position, to transition the first expansion device 140 to an open or partially open position, and to transition the second control valve 192 and the second expansion device 142 to closed positions. As such, the controller 200 may operate the cooling compressor 148, which may be selected for improved (e.g., more efficient) operation of the heat pump 102 in the cooling mode, to circulate working fluid through the working fluid circuit 108 to enable operation of the heat pump 102 in the cooling mode in accordance with the techniques above. In response to receiving a call to operate the heat pump 102 in the heating mode, the controller 200 may send control instructions to operate the heating compressor 150 and to suspend or stay (e.g., block) operation of the cooling compressor 148, to transition the second control valve 192 to an open position, to transition the second expansion device 142 to an open or partially open position, and to transition the first control valve 190 and the first expansion device 140 to closed positions Accordingly, the controller 200 may operate the heating compressor 150, which may be selected for improved (e.g., more efficient) operation of the heat pump 102 in the heating mode, to circulate working fluid through the working fluid circuit 108 to facilitate heating of the thermal load 110 in accordance with the techniques above.

Figure 7:
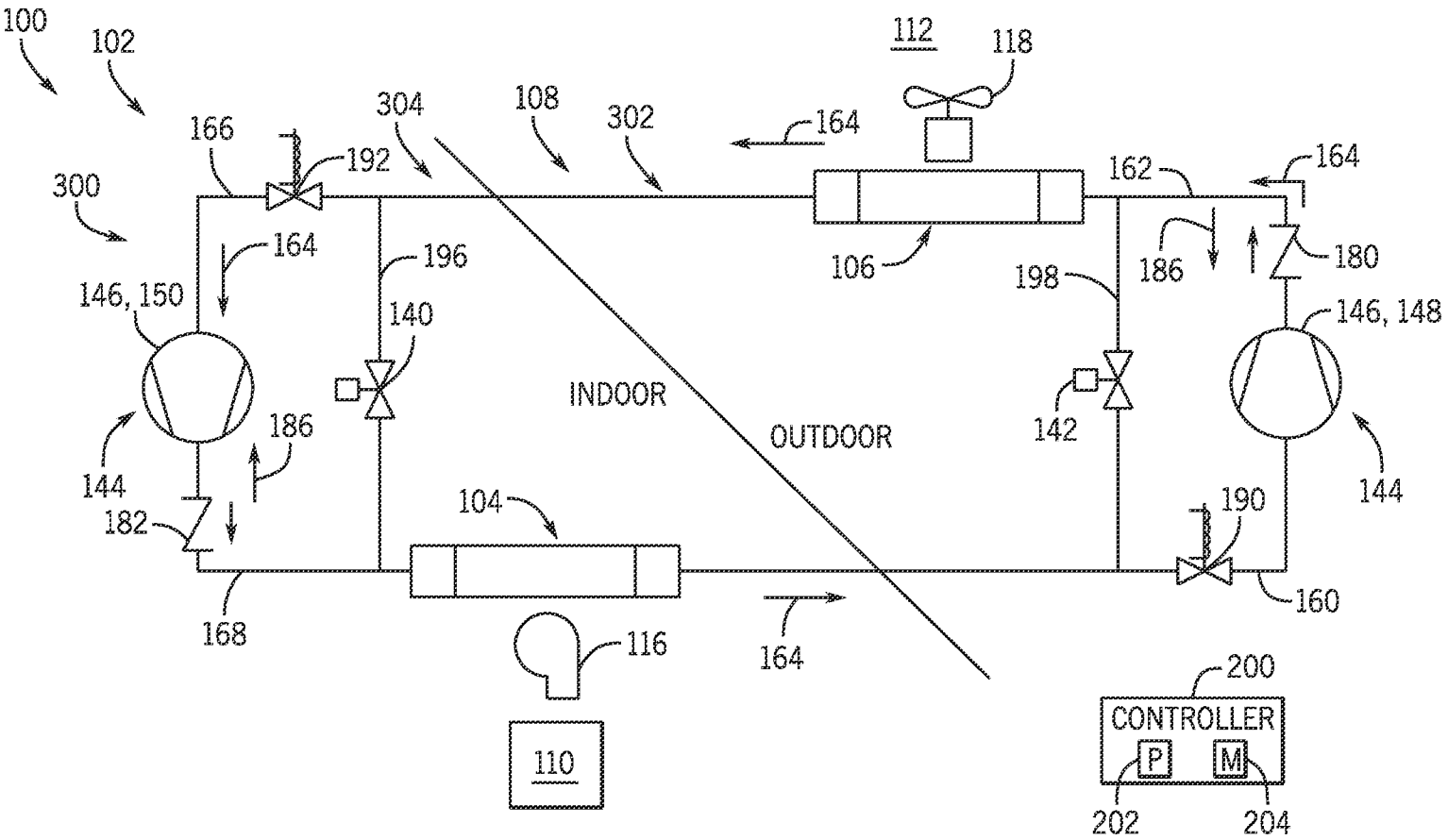
FIG. 7 is a schematic diagram of an embodiment of a portion of an HVAC system that includes a split heat pump system, in accordance with an aspect of the present disclosure.

FIG. 7 is a schematic of an embodiment of the HVAC system 100, illustrating the heat pump 102 in a split configuration 300. The illustrated embodiment includes elements and element numbers similar to those discussed above with reference to FIG. 5. In the split configuration 300, the heat pump 102 may include an outdoor unit 302 (e.g., outdoor system) having the first compressor 148, the second expansion device 142, the first control valve 190, the second fan 118, and/or the second heat exchanger 106, for example. Moreover, in the split configuration 300, the heat pump 102 may include an indoor unit 304 (e.g., indoor system) having the second compressor 150, the first expansion device 140, the second control valve 192, the first fan 116, and/or the first heat exchanger 104, for example. Thus, the outdoor unit 302 and the indoor unit 304 may include portions of the HVAC system 100 that are disposed at different locations with respect to one another. In particular, the outdoor unit 302 may be positioned in the ambient environment 112, while the indoor unit 304 may be positioned within the thermal load 110 and/or adjacent to the thermal load 110 (e.g., a room or area adjacent to the space conditioned by the HVAC system 100). It should be understood that a portion of the working fluid circuit 108 included in the outdoor unit 302 may be fluidly coupled to a remaining portion of the working fluid circuit 108 included in the indoor unit 304 via connection portions (e.g., conduits) of the working fluid circuit 108.

In some embodiments, the indoor unit 304 (e.g., indoor system) may include multiple enclosures disposed within the thermal load 110 and/or adjacent to the thermal load 110 (e.g., a room or area adjacent to the space conditioned by the HVAC system 100). For example, the first expansion device 140, the second control valve 192, the first fan 116, and/or the first heat exchanger 104 may be disposed within a first enclosure or housing, and the second compressor 150 may be disposed within a second enclosure or housing. As will be appreciated, positioning the second compressor 150 within the thermal load 110 and/or adjacent the thermal load 110 may enable improved, more efficient operation of the heat pump 102 due to reduced parasitic losses of the compressor 150 that may otherwise occur with the second compressor 150 positioned within the ambient environment 112.

Figure 8:
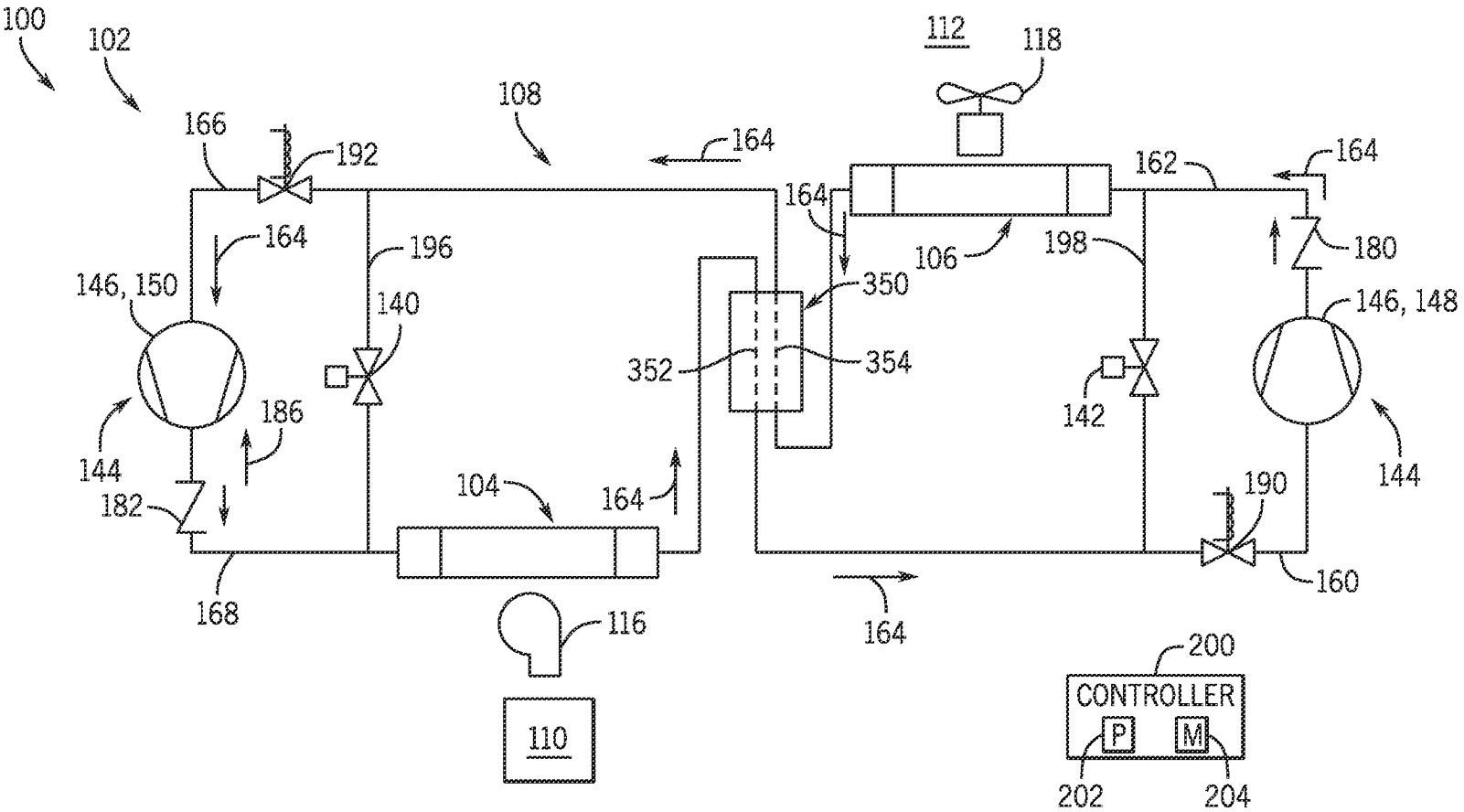
FIG. 8 is a schematic diagram of an embodiment of a portion of an HVAC system that includes a heat pump system having an intermediate heat exchanger, in accordance with an aspect of the present disclosure.

FIG. 8 is a schematic of an embodiment of the HVAC system 100, illustrating the heat pump 102 in having an intermediate heat exchanger 350 (e.g., a liquid-to-suction heat exchanger). The illustrated embodiment also includes elements and element numbers similar to those discussed above with reference to FIG. 5. The intermediate heat exchanger 350 may include a first flow path 352 (e.g., conduit, tube, passage) that is fluidly coupled to and/or forms a portion of the first suction conduit 160 and include a second flow path 354 (e.g., conduit, tube, passage) that is fluidly coupled to and/or forms a portion of the second suction conduit 166. The intermediate heat exchanger 350 may be configured to facilitate heat exchange between working fluid flowing through the first flow path 352 and working fluid flowing through the second flow path 354 during operation of the heat pump 102. For example, during operation of the heat pump 102 in the cooling mode, the first flow path 352 of the intermediate heat exchanger 350 may receive a flow of relatively cool working fluid from the first heat exchanger 104 and may facilitate cooling (e.g., removing thermal energy from) relatively warm working fluid discharged from the second heat exchanger 106 and entering the second flow path 354 of the intermediate heat exchanger 250, prior to the relatively warm working fluid reaching the first expansion device 140. Conversely, during operation of the heat pump 102 in the heating mode, the second flow path 354 may receive a flow of relatively cool working fluid from the second heat exchanger 106 and may facilitate cooling (e.g., removing thermal energy from) relative warm working fluid discharged from the first heat exchanger 104 and entering the first flow path 352, prior to the relatively warm working fluid reaching the second expansion device 142. In this manner, the intermediate heat exchanger 350 may enhance an overall operational efficiency (e.g., improved energy efficiency and/or reduced energy consumption) of the heat pump 102. The intermediate heat exchanger 350 may facilitate enhanced operation for embodiments of the heat pump 102 utilizing carbon dioxide as the working fluid in the working fluid circuit 108, for example. Additionally or alternatively, the working fluid may include propane and/or another suitable fluid or combination of fluids.

Figure 9:
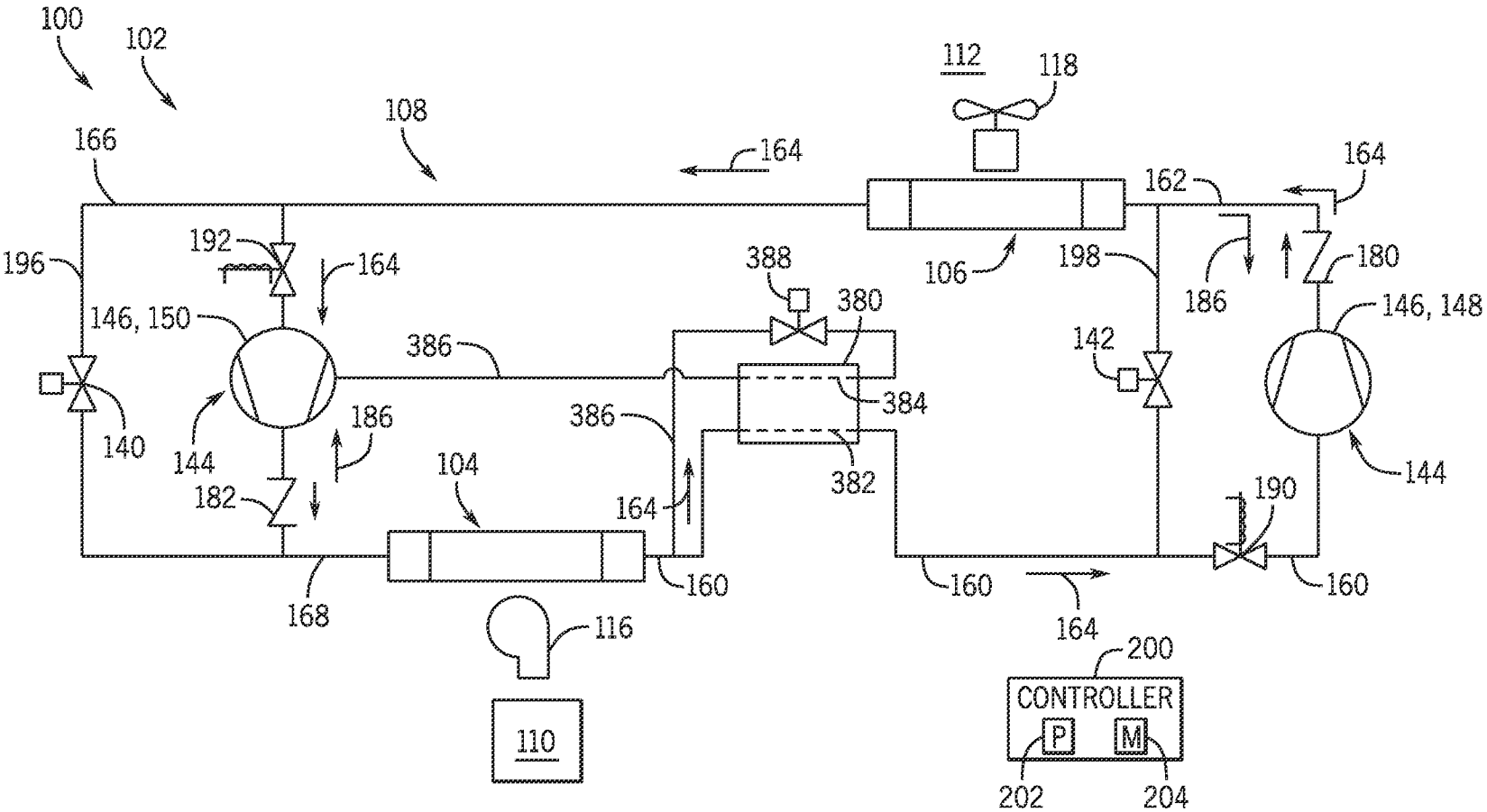
FIG. 9 is a schematic diagram of an embodiment of a portion of an HVAC system that includes a heat pump system having a subcooler, in accordance with an aspect of the present disclosure.

FIG. 9 is a schematic of an embodiment of the HVAC system 100, illustrating the heat pump 102 having a subcooler 380 (e.g., a heat exchanger) disposed along the working fluid circuit 108 and configured to enhance an operational efficiency of the HVAC system 100. The illustrated embodiment also includes elements and element numbers similar to those discussed above with reference to FIG. 5. The subcooler 380 includes a first flow path 382 (e.g., conduit, tube, passage) that is fluidly coupled to and/or forms a portion of the first suction conduit 160. The subcooler 380 includes a second flow path 384 (e.g., conduit, tube, passage) that is fluidly coupled to and/or forms a portion of a conduit 386 (e.g., injection conduit, line, tube, flow path) that may extend between the heating compressor 150 and a portion of the first suction conduit 160 between the first heat exchanger 104 and the subcooler 380. The heat pump 102 may include a third expansion device 388 (e.g., expansion valve) disposed along (e.g., coupled to) the conduit 386.

In the illustrated embodiment of FIG. 9, the heat pump 102 is configured for operation in the heating mode. In the heating mode, the heating compressor 150 may operate to circulate a flow of working fluid through the first heat exchanger 104, the second expansion device 142, the second heat exchanger 106, and the second control valve 192, in accordance with the techniques discussed above, while the cooling compressor 148 is in an inactive (e.g., idle) state. Further, in the heating mode, the heating compressor 150 may operate to direct a first portion of a working fluid flow discharged from the first heat exchanger 104 through the first flow path 382 of the subcooler 380 and to direct a second portion of the working fluid flow discharged from the first heat exchanger 104 through the second flow path 384 of the subcooler 380. In particular, the heating compressor 150 may draw the second portion of the working fluid flow from the first heat exchanger 104 via the conduit 386, such that the second portion of the working fluid flow is directed through the third expansion device 388 and is expanded prior to receipt by the heating compressor 150. The third expansion device 388 may control flow parameters (e.g., flow rate, pressure, temperature) of working fluid along the conduit 386. The subcooler 380 may enable relatively cool working fluid flowing through the second flow path 384 to absorb thermal energy (e.g., heat) from relatively warm working fluid flowing through the first flow path 382. As one of skill in the art would appreciate, in this manner, the subcooler 380 may, via economized vapor injection, increase overall efficiency of the heating compressor 150 (e.g., with reduced energy consumption and/or improved energy efficiency) while also enabling operation of the heat pump 102 in accordance with the presently disclosed techniques.

As set forth above, embodiments of the present disclosure may provide one or more technical effects useful for selectively enabling operation of a heat pump system in both a cooling mode or a heating mode without implementation of a reversing valve and/or without operating heat exchangers of the heat pump system in a parallel flow configuration. That is, the heat pump system of the present disclosure enables one or more heat exchangers of the heat pump system to operate in a counterflow configuration (e.g., counterflow heat transfer arrangement) during both a heating mode of the heat pump system and a cooling mode of the heat pump system. As such, implementation of the disclosed techniques may improve an overall operational efficiency of an HVAC system during cooling and heating operations, such as improved heat transfer efficiency, improved energy efficiency, and/or reduced energy consumption. Indeed, the HVAC systems disclosed herein are configured to operate with reduced greenhouse gas emissions by operating to heat and cool an air flow in an energy efficient manner and without operation of a furnace or other system that consumes a fuel. The disclosed techniques also enable a reduction in costs and complexity associated with operation and/or maintenance of the HVAC system. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat pump for a heating, ventilation, and air conditioning (HVAC) system, comprising:

a compressor system configured to direct a working fluid along a working fluid circuit of the heat pump, wherein the compressor system comprises:

a first compressor configured to direct the working fluid along a first portion of the working fluid circuit comprising a first expansion device to operate the heat pump in a cooling mode; and a second compressor configured to direct the working fluid along a second portion of the working fluid circuit comprising a second expansion device to operate the heat pump in a heating mode;

a heat exchanger disposed along the working fluid circuit, wherein the second compressor is configured to direct, during operation of the heat pump in the heating mode, the working fluid through two or more passes of the heat exchanger in a first sequential order to place the working fluid in a counterflow heat transfer arrangement with a supply air flow directed across the two or more passes of the heat exchanger in a second sequential order opposite the first sequential order, and the heat exchanger is configured to heat the supply air flow during operation of the heat pump in the heating mode;

a first solenoid valve disposed along the working fluid circuit upstream of the first compressor relative to flow of the working fluid along the working fluid circuit, wherein the first solenoid valve is configured to control flow of the working fluid into the first compressor;

a second solenoid valve disposed along the working fluid circuit upstream of the second compressor relative to flow of the working fluid along the working fluid circuit, wherein the second solenoid valve is configured to control flow of the working fluid into the second compressor; and a controller communicatively coupled to the first compressor, the second compressor, the first solenoid valve, and the second solenoid valve, wherein the controller is configured to:

open the first solenoid valve, close the second solenoid valve, operate the first compressor, and suspend operation of the second compressor in the cooling mode; and open the second solenoid valve, close the first solenoid valve, operate the second compressor, and suspend operation of the first compressor in the heating mode, wherein the heat pump is configured to discharge the supply air flow toward a conditioned space.

2. The heat pump of claim 1, wherein the first compressor is configured to direct, during operation of the heat pump in the cooling mode, the working fluid through the two or more passes of the heat exchanger in the first sequential order to place the working fluid in the counterflow heat transfer arrangement with the supply air flow directed across the two or more passes of the heat exchanger in the second sequential order, and the heat exchanger is configured to cool the supply air flow during operation of the heat pump in the cooling mode.

3. The heat pump of claim 1, wherein the heat exchanger is a first heat exchanger, the heat pump comprises one or more conduits configured to fluidly couple the first heat exchanger and a second heat exchanger of the heat pump to the compressor system, and the heat pump excludes a reversing valve disposed along the one or more conduits.

4. The heat pump of claim 1, wherein the first compressor is configured to direct the working fluid along the working fluid circuit in a designated flow direction in the cooling mode, and the second compressor is configured to direct the working fluid along the working fluid circuit in the designated flow direction in the heating mode.

5. The heat pump of claim 4, comprising:

a first check valve disposed along the working fluid circuit downstream of the first compressor relative to flow of the working fluid along the working fluid circuit, wherein the first check valve is configured to block flow of the working fluid into the first compressor in a reverse flow direction opposite the designated flow direction; and a second check valve disposed along the working fluid circuit downstream of the second compressor relative to flow of the working fluid along the working fluid circuit, wherein the second check valve is configured to block flow of the working fluid into the second compressor in the reverse flow direction opposite the designated flow direction.

6. The heat pump of claim 1, wherein the controller is communicatively coupled to the first expansion device and the second expansion device, and the controller is configured to:

close the second expansion device and control the first expansion device to enable flow of the working fluid through the first expansion device in the cooling mode; and close the first expansion device and control the second expansion device to enable flow of the working fluid through the second expansion device in the heating mode.

7. The heat pump of claim 2, comprising the working fluid circuit, wherein the working fluid circuit comprises a first suction conduit extending between the heat exchanger and a first suction side of the first compressor, the first suction conduit is configured to direct flow of the working fluid from the heat exchanger toward the first compressor in the cooling mode, and the first solenoid valve is disposed along the first suction conduit.

8. The heat pump of claim 7, wherein the heat exchanger is a first heat exchanger, the heat pump comprises a second heat exchanger disposed along the working fluid circuit, the working fluid circuit comprises a second suction conduit extending between the second heat exchanger and a second suction side of the second compressor, the second suction conduit is configured to direct flow of the working fluid from the second heat exchanger toward the second compressor in the heating mode, and the second solenoid valve is disposed along the second suction conduit.

9. The heat pump of claim 8, wherein the working fluid circuit comprises a first discharge conduit extending between a first discharge side of the first compressor and the second heat exchanger, the first discharge conduit is configured to direct flow of the working fluid from the first compressor toward the second heat exchanger in the cooling mode, the heat pump comprises a first check valve disposed along the first discharge conduit, and the first check valve is configured to block flow of the working fluid along the first discharge conduit to the first discharge side of the first compressor in the heating mode.

10. The heat pump of claim 9, wherein the working fluid circuit comprises a second discharge conduit extending between a second discharge side of the second compressor and the first heat exchanger, the second discharge conduit is configured to direct flow of the working fluid from the second compressor toward the first heat exchanger in the heating mode, the heat pump comprises a second check valve disposed along the second discharge conduit, and the second check valve is configured to block flow of the working fluid along the second discharge conduit to the second discharge side of the second compressor in the cooling mode.

11. The heat pump of claim 8, comprising a third heat exchanger disposed along the working fluid circuit, wherein the third heat exchanger defines a first flow path configured to receive a first flow of the working fluid from the first heat exchanger and a second flow path configured to receive a second flow of the working fluid from the second heat exchanger, and the third heat exchanger is configured to place the first flow of the working fluid in a heat exchange relationship with the second flow of the working fluid in the heating mode and in the cooling mode.

12. The heat pump of claim 8, comprising a third heat exchanger disposed along the working fluid circuit, wherein the third heat exchanger defines a first flow path and a second flow path, the working fluid circuit comprises an additional conduit extending from the first suction conduit to the second compressor, the first flow path is disposed along the first suction conduit, the second flow path is disposed along the additional conduit, and the third heat exchanger is configured to place a first flow of the working fluid directed along the first suction conduit in a heat exchange relationship with a second flow of the working fluid directed along the additional conduit.

13. The heat pump of claim 12, wherein the additional conduit extends from the first suction conduit upstream of the first flow path of the third heat exchanger relative to flow of the first flow of the working fluid along the first suction conduit.

14. The heat pump of claim 13, comprising a third expansion device disposed along the additional conduit upstream of the third heat exchanger relative to flow of the second flow of the working fluid along the additional conduit.

15. The heat pump of claim 14, wherein the second compressor is configured to receive a first portion of the working fluid via the second suction conduit in the heating mode, and the second compressor is configured to receive a second portion of the working fluid, separate from the first portion of the working fluid, via the additional conduit in the heating mode.

16. The heat pump of claim 1, wherein the heat exchanger comprises a first pass of one or more heat exchange tubes, a second pass of the one or more heat exchange tubes, and a third pass of the one or more heat exchange tubes, the second compressor is configured to direct the working fluid sequentially through the first pass, the second pass, and the third pass in the first sequential order, and the heat pump comprises a fan configured to direct the supply air flow sequentially across the third pass, the second pass, and the first pass in the second sequential order.

17. A heat pump for a heating, ventilation, and air conditioning (HVAC) system, comprising:

a working fluid circuit;

a compressor system configured to direct a working fluid along the working fluid circuit, wherein the compressor system comprises:

a first compressor configured to direct the working fluid along a first portion of the working fluid circuit comprising a first expansion device to operate the heat pump in a cooling mode; and a second compressor configured to direct the working fluid along a second portion of the working fluid circuit comprising a second expansion device to operate the heat pump in a heating mode;

a first heat exchanger disposed along the working fluid circuit, wherein the first compressor is configured to direct, during operation of the heat pump in the cooling mode, the working fluid through two or more passes of the first heat exchanger in a first sequential order to place the working fluid in a counterflow heat transfer arrangement with an air flow directed across the two or more passes of the first heat exchanger in a second sequential order opposite the first sequential order;

a second heat exchanger disposed along the working fluid circuit;

a third heat exchanger disposed along the working fluid circuit, wherein the third heat exchanger defines a first flow path configured to receive a first flow of the working fluid from the first heat exchanger and a second flow path configured to receive a second flow of the working fluid from the second heat exchanger, and the third heat exchanger is configured to place the first flow of the working fluid in a heat exchange relationship with the second flow of the working fluid in the heating mode and in the cooling mode;

a first solenoid valve disposed along the working fluid circuit upstream of the first compressor relative to flow of the working fluid along the working fluid circuit, wherein the first solenoid valve is configured to control flow of the working fluid into the first compressor;

a second solenoid valve disposed along the working fluid circuit upstream of the second compressor relative to flow of the working fluid along the working fluid circuit, wherein the second solenoid valve is configured to control flow of the working fluid into the second compressor; and a controller communicatively coupled to the first compressor, the second compressor, the first solenoid valve, and the second solenoid valve, wherein the controller is configured to:

open the first solenoid valve, close the second solenoid valve, operate the first compressor, and suspend operation of the second compressor in the cooling mode; and open the second solenoid valve, close the first solenoid valve, operate the second compressor, and suspend operation of the first compressor in the heating mode.

18. The heat pump of claim 17, wherein the second compressor is configured to direct, during operation of the heat pump in the heating mode, the working fluid through the two or more passes of the first heat exchanger in the first sequential order to place the working fluid in the counterflow heat transfer arrangement with the air flow directed across the two or more passes of the first heat exchanger in the second sequential order, and the first heat exchanger is configured to heat the air flow during operation of the heat pump in the heating mode.

19. A heat pump for a heating, ventilation, and air conditioning (HVAC) system, comprising:

a working fluid circuit;

a compressor system configured to direct a working fluid along the working fluid circuit, wherein the compressor system comprises:

a first compressor configured to direct the working fluid along a first portion of the working fluid circuit comprising a first expansion device to operate the heat pump in a cooling mode; and a second compressor configured to direct the working fluid along a second portion of the working fluid circuit comprising a second expansion device to operate the heat pump in a heating mode;

a first heat exchanger disposed along the working fluid circuit, wherein the first compressor is configured to direct, during operation of the heat pump in the cooling mode, the working fluid through two or more passes of the first heat exchanger in a first sequential order to place the working fluid in a counterflow heat transfer arrangement with an air flow directed across the two or more passes of the first heat exchanger in a second sequential order opposite the first sequential order;

a second heat exchanger disposed along the working fluid circuit;

a suction conduit extending between the first heat exchanger and a suction side of the first compressor, wherein the suction conduit is configured to direct flow of the working fluid from the first heat exchanger toward the first compressor in the cooling mode;

a third heat exchanger disposed along the working fluid circuit, wherein the third heat exchanger defines a first flow path and a second flow path, the working fluid circuit comprises an additional conduit extending from the suction conduit to the second compressor, the first flow path is disposed along the suction conduit, the second flow path is disposed along the additional conduit, and the third heat exchanger is configured to place a first flow of the working fluid directed along the suction conduit in a heat exchange relationship with a second flow of the working fluid directed along the additional conduit;

a first solenoid valve disposed along the working fluid circuit upstream of the first compressor relative to flow of the working fluid along the working fluid circuit, wherein the first solenoid valve is configured to control flow of the working fluid into the first compressor;

a second solenoid valve disposed along the working fluid circuit upstream of the second compressor relative to flow of the working fluid along the working fluid circuit, wherein the second solenoid valve is configured to control flow of the working fluid into the second compressor; and a controller communicatively coupled to the first compressor, the second compressor, the first solenoid valve, and the second solenoid valve, wherein the controller is configured to:

open the first solenoid valve, close the second solenoid valve, operate the first compressor, and suspend operation of the second compressor in the cooling mode; and open the second solenoid valve, close the first solenoid valve, operate the second compressor, and suspend operation of the first compressor in the heating mode.

20. The heat pump of claim 19, wherein the second compressor is configured to direct, during operation of the heat pump in the heating mode, the working fluid through the two or more passes of the first heat exchanger in the first sequential order to place the working fluid in the counter-flow heat transfer arrangement with the air flow directed across the two or more passes of the first heat exchanger in the second sequential order, and the first heat exchanger is configured to heat the air flow during operation of the heat pump in the heating mode.

* * * * *